US012232678B2

(12) United States Patent
Sing et al.

(10) Patent No.: US 12,232,678 B2
(45) Date of Patent: Feb. 25, 2025

(54) DOMESTIC APPLIANCE, METHOD FOR PRODUCING A DOMESTIC APPLIANCE AND METHOD FOR DISMANTLING A DOMESTIC APPLIANCE

(71) Applicant: BSH Hausgeräte GmbH, Munich (DE)

(72) Inventors: Alexander Sing, Wittislingen (DE); Heiko Fritz, Herbrechtingen (DE); Andreas Hitzler, Holzheim (DE); Georg Walther, Munich (DE)

(73) Assignee: BSH Hausgeräte GmbH, Munich (DE)

( * ) Notice: Subject to any disclaimer, the term of this patent is extended or adjusted under 35 U.S.C. 154(b) by 845 days.

(21) Appl. No.: 17/282,792

(22) PCT Filed: Sep. 30, 2019

(86) PCT No.: PCT/EP2019/076418
§ 371 (c)(1),
(2) Date: Apr. 5, 2021

(87) PCT Pub. No.: WO2020/074301
PCT Pub. Date: Apr. 16, 2020

(65) Prior Publication Data

US 2021/0401259 A1 Dec. 30, 2021

(30) Foreign Application Priority Data

Dec. 10, 2018 (DE) ..... 10 2018 217 537.3

(51) Int. Cl.
*A47L 15/42* (2006.01)

(52) U.S. Cl.
CPC ..... *A47L 15/4209* (2016.11); *A47L 15/4246* (2013.01)

(58) Field of Classification Search
None
See application file for complete search history.

(56) References Cited

U.S. PATENT DOCUMENTS 4,735,284 A 4/1988 Gahlau
4,839,397 A 6/1989 Lohmar
(Continued)

FOREIGN PATENT DOCUMENTS

CN 107053809 A 8/2017
DE 4110291 A1 10/1992
(Continued)

OTHER PUBLICATIONS

National Search Report CN 2019800664643 dated Sep. 27, 2023.
(Continued)

*Primary Examiner* — Levon J Shahinian
(74) *Attorney, Agent, or Firm* — Michael E. Tschupp; Andre Pallapies; Brandon G. Braun

(57) ABSTRACT

A household appliance includes a functional cavity and an insulation arrangement which is arranged on an outside of the functional cavity for thermal and/or acoustic insulation of the functional cavity. The insulation arrangement includes a one-piece insulation element of a synthetic material which is selected such that a surface of the first insulation element in facing relation to the functional cavity adheres to the functional cavity and is separable therefrom in a non-destructive manner.

19 Claims, 10 Drawing Sheets

(56) References Cited

U.S. PATENT DOCUMENTS

| | | | | |
|---|---|---|---|---|
| 5,992,954 | A * | 11/1999 | Becker | A47L 15/4272 312/228 |
| 6,345,481 | B1 | 2/2002 | Nelson | |
| 2005/0079739 | A1 | 4/2005 | Illerhaus | |
| 2010/0108105 | A1 | 5/2010 | Classen | |
| 2013/0303648 | A1* | 11/2013 | Selifonov | C07D 317/30 528/73 |
| 2016/0270532 | A1 | 9/2016 | Gleixner | |

FOREIGN PATENT DOCUMENTS

| | | | |
|---|---|---|---|
| DE | 4110292 | A1 | 10/1992 |
| DE | 4227957 | A1 | 2/1994 |
| DE | 19858002 | A1 | 6/2000 |
| DE | 20213287 | U1 | 12/2002 |
| DE | 102010031484 | A1 | 1/2012 |
| DE | 102010031493 | A1 | 1/2012 |
| DE | 102010039101 | A1 | 2/2012 |
| DE | 102011077734 | A1 | 12/2012 |
| DE | 202012103799 | U1 | 12/2012 |
| DE | 102012201244 | A1 | 8/2013 |
| EP | 3092934 | A1 | 11/2016 |
| EP | 3092935 | A1 | 11/2016 |

OTHER PUBLICATIONS

Report of Examination DE 10 2018 217 537.3 dated Oct. 6, 2021.
International Search Report PCT/EP2019/O76418 dated Nov. 15, 2019.

* cited by examiner

DOMESTIC APPLIANCE, METHOD FOR PRODUCING A DOMESTIC APPLIANCE AND METHOD FOR DISMANTLING A DOMESTIC APPLIANCE

CROSS-REFERENCES TO RELATED APPLICATIONS

This application is the U.S. National Stage of International Application No. PCT/EP2019/076418 filed Sep. 30, 2019, which designated the United States and has been published as International Publication No. WO 2020/074301 A1 and which claims the priority of German Patent Application, Serial No. 10 2018 217 537.3, filed Oct. 12, 2018, pursuant to 35 U.S.C. 119 (a)-(d).

BACKGROUND OF THE INVENTION

The present invention relates to a household appliance, in particular a household dishwasher, a method for producing a household appliance of this type and a method for dismantling a household appliance of this type.

In order to provide the acoustic insulation of a dishwasher cavity of a household dishwasher, it is possible to attach bitumen mats to the outside of the dishwasher cavity. These bitumen mats can be adhered for example with the aid of a melt adhesive to the outside of the dishwasher cavity. However, bitumen mats of this type have a high thermal absorption capacity and dissipate the absorbed heat from the dishwasher cavity. If the portion of the surface of the dishwasher cavity that is covered by the bitumen mats is reduced, it is possible to reduce the energy consumption of the household dishwasher. However, this reduction of the surface that is covered by the bitumen mats results in an increase in the noise emission of the household dishwasher.

The publication DE 20 2012 103 799 U1 discloses a sound-absorbing sandwich plate that can be used so as to damp the noise from a household dishwasher. The sandwich plate has a first layer so as to provide sound insulation and a second layer so as to damp noise and/or to provide a thermal insulation. The sound-absorbing sandwich plate is provided as a prefabricated component and can be adhered for example to a dishwasher cavity of a household dishwasher.

The publication DE 10 2010 031 484 A1 discloses a household dishwasher having at least one component that is provided with a bitumen mat so as to damp noise and/or to absorb sound from the component, wherein the bitumen mat is adhered to the component by means of at least one adhesive layer of a reactively cured bituminous compound.

The publication DE 10 2011 077 734 A1 discloses a household dishwasher, wherein the household dishwasher comprises a cavity that has a wall and is intended for receiving items that are to be processed and wherein at least one layer of insulating material is allocated to the outside of at least one of these walls. The household dishwasher is embodied in such a manner that at least one shaped body is arranged between the respective wall and the respective insulated layer and the face of said shaped body that in the assembled position faces the dishwasher cavity has a negative relief of corrugations, embossed features or similar shapings that are provided on the respective fixed or movable wall.

The publication EP 3 092 935 A1 discloses an arrangement so as to provide thermal and acoustic insulation of a receiving region of a household dishwasher. The arrangement comprises a first insulation element so as to provide thermal insulation of the receiving region and a second insulation element so as to provide acoustic insulation of the receiving region, wherein the first insulation element is arranged between the receiving region and the second insulation element and wherein the first insulation element is foamed directly onto the receiving region.

BRIEF SUMMARY OF THE INVENTION

Based on this background, an object of the present invention is to provide an improved household appliance, in particular an improved household dishwasher.

Accordingly, the invention proposes a household appliance, in particular a household dishwasher, having a functional cavity, in particular having a dishwasher cavity, and having an insulation arrangement that is provided on the outside of the functional cavity, in particular on the outside of the dishwasher cavity, so as to provide thermal and/or acoustic insulation of the functional cavity, in particular of the dishwasher cavity, wherein the insulation arrangement has an insulation element and wherein the insulation element is manufactured from one piece of a synthetic material that in a cured and/or cross-linked state has preferably adhesive properties with the result that the insulation element adheres by means of a surface that is facing the functional cavity, in particular facing the dishwasher cavity, to the functional cavity, in particular to the dishwasher cavity, and said insulation element can be separated from said functional cavity, in particular from said dishwasher cavity, in a non-destructive manner.

By virtue of the fact that the synthetic material itself has preferably adhesive properties, it is possible during the production of the household appliance, in particular of the household dishwasher, to forego a method step of attaching an adhesive or an adhesive layer to the insulation element and/or to the functional cavity, in particular to the dishwasher cavity. Thus, the household appliance, in particular the household dishwasher, can be produced in a cost-effective manner. By virtue of the fact that the insulation element can be separated in a non-destructive manner and in particular also in a residue-free manner from the functional cavity, in particular from the dishwasher cavity, it is possible at the end of the serviceable life of the household appliance, in particular of the household dishwasher, to separate the insulation arrangement in a simple manner from the functional cavity, in particular from the dishwasher cavity, and both components can be supplied to a recycling loop without any contaminants or with only minimal contaminants.

It is preferred that the insulation element is manufactured throughout from the synthetic material. The phrase "from one piece of material" means in this case that the insulation element has only one material, namely the previously mentioned synthetic material. The functional cavity, in particular the dishwasher cavity, has in particular a cuboid shape and comprises a bottom, a rear wall, a ceiling, two side walls, which are arranged opposite one another, and a door. In this case, the insulation arrangement can be provided on the rear wall, the ceiling, the side walls and/or on the door respectively. Moreover, the insulation arrangement can also be provided on the bottom. The functional cavity, in particular the dishwasher cavity, and the door encompass a functional interior space, in particular a dishwasher interior space, of the household appliance, in particular of the household dishwasher. Items to be cleaned can be accommodated in the functional cavity, in particular in the dishwasher cavity. The insulation element can also be referred to as the first insulation element. The insulation element is suitable for thermally and/or acoustically insulating the functional cavity, in particular the dishwasher cavity. The insulation element can therefore also be referred to as the thermal and/or acoustic insulation element.

The phrase "on the outside" means in this case remote from the functional cavity, in particular from the dishwasher cavity. For example, the rear wall, the bottom, the ceiling, the side walls and/or the door have in each case an inner face that faces the functional interior space, in particular faces the dishwasher interior space, and an outer face that is remote from the functional interior space, in particular remote from the dishwasher interior space. The insulation arrangement is provided on the respective outer face. The statement that the insulation element can be separated in a "non-destructive manner" from the functional cavity, in particular from the dishwasher cavity, is to be understood to mean that the insulation element can be pulled off or removed from the functional cavity, in particular from the dishwasher cavity, without any residue of the insulation element remaining adhered to the functional cavity, in particular to the dishwasher cavity. However, it is also possible that negligible amounts of residue remain adhered to the functional cavity, in particular adhered to the dishwasher cavity. In other words, the insulation element can be easily released from the functional cavity, in particular from the dishwasher cavity, but residue can remain on the functional cavity, in particular on the dishwasher cavity. The residue can be removed by rubbing. In particular, the insulation element can be separated from the functional cavity, in particular from the dishwasher cavity, without the aid of an auxiliary agent, such as for example a solvent. The connection between the insulation element and the functional cavity, in particular the dishwasher cavity, can be a weakly adhering adhesive connection.

The synthetic material can have multiple components that are mixed so as to produce the insulation element and that chemically react with one another in such a manner that the synthetic material is completely cured and/or cross-linked. The synthetic material itself has the preferably adhesive or preferably adhering properties. The term "adhesion" is to be understood in the present case to be the property of the synthetic material whereby the surface of the insulation element that is facing the dishwasher cavity interacts with an outer face of the functional cavity, in particular of the dishwasher cavity, in such a manner that the insulation element adheres to the functional cavity, in particular to the dishwasher cavity. In this case, the adhesion can relate to molecular interactions between the synthetic material and the material of the functional cavity, in particular of the dishwasher cavity. Furthermore, the adhesion can also relate to physical-mechanical forces. For example, the synthetic material can become clamped or hooked in microscopically small pores and/or depressions of the functional cavity, in particular of the dishwasher cavity. In particular, the insulation element is connected to the functional cavity, in particular to the dishwasher cavity, without the use of an adhesive material. As previously stated, the synthetic material of the insulation element itself comprises preferably adhesive or preferably adhering properties. Thus, it is possible to forego an adhesive material for connecting the insulation element to the functional cavity, in particular to the dishwasher cavity. This simplifies the production of the household appliance, in particular of the household dishwasher, and renders it possible for the materials used to be recycled more efficiently.

In accordance with one embodiment, the synthetic material is a polyurethane, in particular a foamed polyurethane.

It is preferred that the polyurethane has an open-pore structure. The synthetic material is consequently compressible with the result that, as the synthetic material compresses, air can escape from it. Other suitable synthetic materials can also be used.

In accordance with a further embodiment, the synthetic material has viscoelastic properties.

An in-part elastic, in part viscous material behavior is described as "viscoelastic". Viscoelastic materials consequently combine per se features of solid bodies and fluids.

In accordance with a further embodiment, the insulation arrangement has a first insulation element, which is manufactured from the synthetic material, and a second insulation element, wherein the first insulation element is arranged between the functional cavity, in particular the dishwasher cavity, and the second insulation element.

The second insulation element is optional. The second insulation element can be used to provide the acoustic insulation of the functional cavity, in particular of the dishwasher cavity. The second insulation element can be referred to as the acoustic insulation element. By virtue of the fact that the first insulation element is arranged between the functional cavity, in particular the dishwasher cavity, and the second insulation element, it is not possible for the second insulation element to draw off any heat from the functional cavity, in particular from the dishwasher cavity. This improves the energy efficiency of the household appliance, in particular of the household dishwasher. The second insulation element is used in particular as a mass layer. The second insulation element improves the acoustic properties of the insulation arrangement.

In accordance with a further embodiment, the first insulation element adheres by means of a surface that is facing the second insulation element to the second insulation element and said first insulation element can be separated from said second insulation element in a non-destructive manner.

It is preferred that the first insulation element is connected to the second insulation element without the use of an adhesive. In other words, the synthetic material of the first insulation element adheres to the second insulation element. Alternatively, the insulation elements can also be connected to one another in a non-releasable manner.

In accordance with a further embodiment, a separation layer is arranged between the first insulation element and the second insulation element in order to separate the first insulation element from the second insulation element in a non-destructive manner.

The optional separation layer renders it possible to separate the first insulation element from the second insulation element in a non-destructive and residue-free manner. Thus, the materials of the first insulation element and of the second insulation element can be recycled in a simpler and more efficient manner. It is preferred that the separation layer comprises a wax layer and/or a synthetic film. The separation layer can be in particular a wax layer, a film or multiple films that are laid one on top of the other. The separation layer can be any layer that is suitable for separating the two insulation elements from one another in a residue-free and non-destructive manner. In particular, the first insulation element is connected to the second insulation element without the use of an adhesive material.

In accordance with a further embodiment, the first insulation element is connected in a positive-locking manner to the functional cavity, in particular to the dishwasher cavity.

A positive-locking connection is produced as a result of the at least two connection partners engaging inside or behind one another. A positive-locking connection can be released without damaging the connection partners. The positive-locking connection between the first insulation element and the functional cavity, in particular the dishwasher cavity, supports the preferably adhesive properties of the synthetic material of the first insulation element. Due to the positive-locking connection, it is not possible for the first insulation element to displace with respect to the functional cavity, in particular with respect to the dishwasher cavity. The first insulation element is therefore fixed precisely in position on the functional cavity, in particular on the dishwasher cavity.

In accordance with a further embodiment, the functional cavity, in particular the dishwasher cavity, has on the outside an elevation which engages in a positive-locking manner in a depression that is provided on the first insulation element, and/or the functional cavity, in particular the dishwasher cavity, has on the outside a depression into which an elevation that is provided on the first insulation element engages in a positive-locking manner.

The elevation or depression provided on the functional cavity, in particular on the dishwasher cavity, can be for example an embossed feature, a corrugation or the like. The elevation or depression can be used for example so as to reinforce the functional cavity, in particular the dishwasher cavity. The functional cavity, in particular the dishwasher cavity, can have any number of elevations and/or depressions. The depression that corresponds with the elevation of the functional cavity, in particular of the dishwasher cavity, or the elevation that corresponds with the depression of the functional cavity, in particular of the dishwasher cavity are formed on the first insulation element during the production of said first insulation element, In accordance with a further embodiment, the positive-locking connection between the first insulation element and the functional cavity, in particular the dishwasher cavity, has an amount of play.

In other words, a width and depth of the depression of the first insulation element is greater than a width and height of the elevation of the functional cavity, in particular of the dishwasher cavity. Accordingly, this also applies for the depression of the functional cavity, in particular of the dishwasher cavity, and the elevation of the first insulation element. Thus, the production process of the first insulation element is simplified since it is not necessary to maintain a narrow tolerance range.

In accordance with a further embodiment, the household appliance, in particular the household dishwasher, comprises an external cladding that is provided on the outside of the functional cavity, in particular on the outside of the dishwasher cavity, wherein the second insulation element is arranged between the first insulation element and the external cladding.

The external cladding can be for example a steel plate. The external cladding can be for example part of a housing of the household appliance, in particular of the household dishwasher.

In accordance with a further embodiment, the external cladding lies loosely on the second insulation element or a separation layer is arranged between the second insulation element and the external cladding in order to separate the external cladding from the second insulation element in a non-destructive manner.

Thus, the external cladding that is preferably manufactured from a metal material can be supplied in a simple manner to the recycling loop at the end of the serviceable life of the household appliance, in particular of the household dishwasher. The separation layer can, as previously mentioned, comprise a wax layer, a film or multiple layers of film.

Furthermore, a method is proposed for producing a household appliance of this type, in particular a household dishwasher of this type. The method comprises the steps: a) providing a functional cavity, in particular a dishwasher cavity, b) providing an insulation arrangement so as to provide thermal and/or acoustic insulation of the functional cavity, in particular of the dishwasher cavity, wherein the insulation arrangement has an insulation element and wherein the insulation element is manufactured from one piece of a synthetic material that in a cured and/or cross-linked state has preferably adhesive properties, and c) attaching the insulation arrangement on the outside of the functional cavity, in particular on the outside of the dishwasher cavity, in such a manner that the insulation element adheres by means of a surface that is facing the functional cavity, in particular facing the dishwasher cavity, to the functional cavity, in particular to the dishwasher cavity, and said insulation element can be separated from said functional cavity, in particular from said dishwasher cavity, in a non-destructive manner.

It is possible during the manufacture of the insulation element to cast the synthetic material into a mold and under ambient pressure or in a vacuum to foam-fill a cavity of the mold. In this case, the cavity forms a negative relief of an external geometry of the insulation element.

In accordance with one embodiment, during the step b) the insulation arrangement having a first insulation element, which is manufactured from the synthetic material, and having a second insulation element is provided, wherein in the step c) the insulation arrangement is attached to the outside of the functional cavity, in particular to the outside of the dishwasher cavity, in such a manner that the first insulation element is arranged between the functional cavity, in particular the dishwasher cavity, and the second insulation element.

Prior to the first insulation element being attached to the outside of the functional cavity, in particular to the outside of the dishwasher cavity, the second insulation element can be attached to the first insulation element with the result that the insulation arrangement can be attached as a pre-assembled component to the functional cavity, in particular to the dishwasher cavity. Alternatively, the insulation elements can also be attached one after the other to the functional cavity, in particular to the dishwasher cavity, wherein initially the first insulation element is attached to the functional cavity, in particular to the dishwasher cavity, and subsequently the second insulation element is attached to the first insulation element. It is particularly preferred that at least the surface of the first insulation element that is facing the functional cavity, in particular facing the dishwasher cavity, is protected against dust and/or contaminants. In particular, the first insulation element is protected by a film after said first insulation element is removed from the mold. In this case, the film can be bag-shaped and the first insulation element can be completely accommodated therein. The film can also be provided only on the surface of the first insulation element that is facing the functional cavity, in particular facing the dishwasher cavity. In addition, the film can also be provided on the surface of the first insulation element that is facing the second insulation element. Prior to the first insulation elements or rather the insulation arrangement being attached to the outside of the functional cavity, in particular to the outside of the dishwasher cavity, the film is then removed from the surface and the surface is pressed against the functional cavity, in particular against the dishwasher cavity, whereby the first insulation element is connected to the functional cavity, in particular to the dishwasher cavity.

In accordance with a further embodiment, the first insulation element adheres by means of a surface that is facing the second insulation element to the second insulation element and can be separated therefrom in a non-destructive manner or a separation layer is arranged between the first insulation element and the second insulation element in order to separate the first insulation element in a non-destructive manner from the second insulation element.

This renders it possible at the end of the serviceable life of the household appliance, in particular of the household dishwasher, to supply the second insulation element and the first insulation element into the recycling loop without any contaminants.

Furthermore, a method is proposed for dismantling a household appliance, in particular a household dishwasher, which is produced with the aid of the previously explained method. In the case of the method, the insulation arrangement is separated from the functional cavity, in particular from the dishwasher cavity, in a non-destructive manner.

Furthermore, it is possible in the case of the method for the second insulation element to be separated from the first insulation element in a non-destructive manner. Thus, as already previously mentioned, it is possible in a simple manner to recycle materials of the individual components of the household appliance, in particular of the household dishwasher, at the end of the serviceable life of the household appliance, in particular of the household dishwasher.

Further possible implementations of the invention also include combinations, not explicitly mentioned, of features or embodiments that are described above or below with respect to the exemplary embodiments. In this case, the person skilled in the art will also add individual aspects as improvements or supplements to the respective basic form of the invention.

Further advantageous configurations and aspects of the invention are the subject matter of the dependent claims and of the exemplary embodiments of the invention that are described below. Furthermore, the invention is explained in detail with the aid of preferred embodiments with reference to the attached figures.

DETAILED DESCRIPTION OF EXEMPLARY EMBODIMENTS OF THE PRESENT INVENTION

Figure 1:
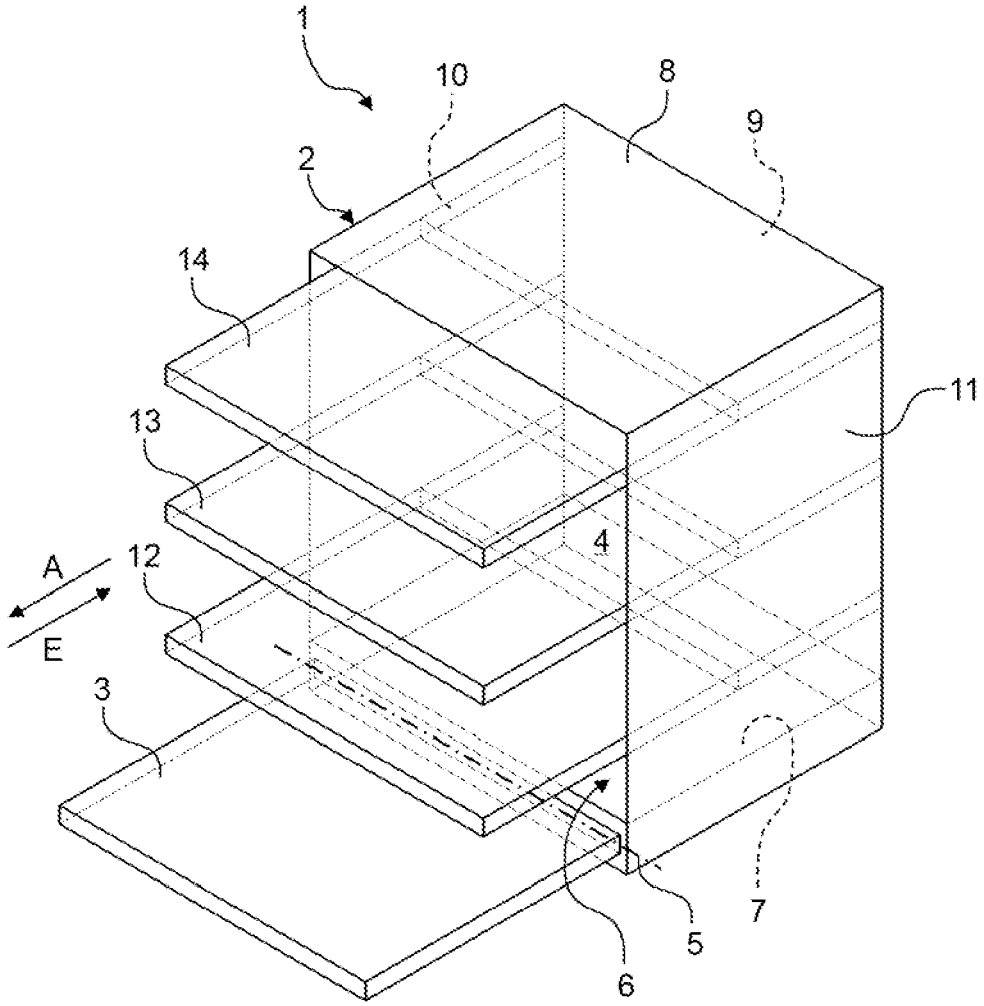
FIG. 1 shows a schematic perspective view of an embodiment of a household appliance in the configuration of a household dishwasher.

Like or like-functioning elements are provided with the same reference numerals in the figures insofar as not otherwise stated.

FIG. 1 illustrates a schematic perspective view of an embodiment of a household appliance 1 in the configuration of a household dishwasher. The household dishwasher 1 comprises a functional cavity in the configuration of a dishwasher cavity 2 that can be closed by a door 3 in particular in a water-tight manner. A sealing facility is provided for this purpose between the door 3 and the dishwasher cavity 2. The dishwasher cavity 2 preferably has a cuboid shape. The dishwasher cavity 2 can be arranged in a housing of the household dishwasher 1. The dishwasher cavity 2 and the door 3 can form a dishwasher interior 4 for washing items to be washed.

The door 3 is illustrated in FIG. 1 in its open position. The door 3 can be closed or opened by pivoting about a pivot axis 5 that is provided on a lower end of the door 3. A loading opening 6 of the dishwasher cavity 2 can be closed or opened with the aid of the door 3. The dishwasher cavity 2 has a bottom 7, a ceiling 8 that is arranged opposite the bottom 7, a rear wall 9 that is arranged opposite the closed door 3, and two side walls 10, 11 that are arranged opposite one another. The bottom 7, the ceiling 8, the rear wall 9 and the side walls 10, 11 can be manufactured for example from a stainless steel sheet. Alternatively, the bottom 7 can for example be manufactured from a synthetic material.

The household dishwasher 1 has moreover at least one receptacle 12 to 14 for items to be washed. It is preferred that multiple, for example three, receptacles 12 to 14 for items to be washed can be provided, wherein the receptacle 12 for items to be washed can be a lower receptacle for items to be washed or a lower basket, the receptacle 13 for items to be washed can be an upper receptacle for items to be washed or an upper basket and the receptacle 14 for items to be washed can be a cutlery drawer. Furthermore, as illustrated in FIG. 1, the receptacles 12 to 14 for items to be washed are arranged one above the other in the dishwasher cavity 2. Each receptacle 12 to 14 for items to be washed can be moved into the dishwasher cavity 2 or out of said dishwasher cavity 2 as desired. In particular, each receptacle 12 to 14 for items to be washed can be slid or moved in an insertion direction E (arrow) into the dishwasher cavity 2 and can be drawn out or moved out of the dishwasher cavity 2 in a withdrawal direction A (arrow) in the opposite direction to the insertion direction E (arrow).

The household appliance 1 in accordance with the invention can generally be a household dishwasher, a household washing machine or a household washer-dryer. Depending upon the type of household appliance, the functional cavity can be a dishwasher cavity, an outer tub or a washing drum. A household washing machine of this type is for example disclosed in the publication EP 2 049 723 A1, whereas a household washer-dryer of this type is known from the publication DE 33 45 303 A1. The relevant content of these publications mentioned in an exemplary manner hereby becomes the subject matter of the present description.

Figure 2A:
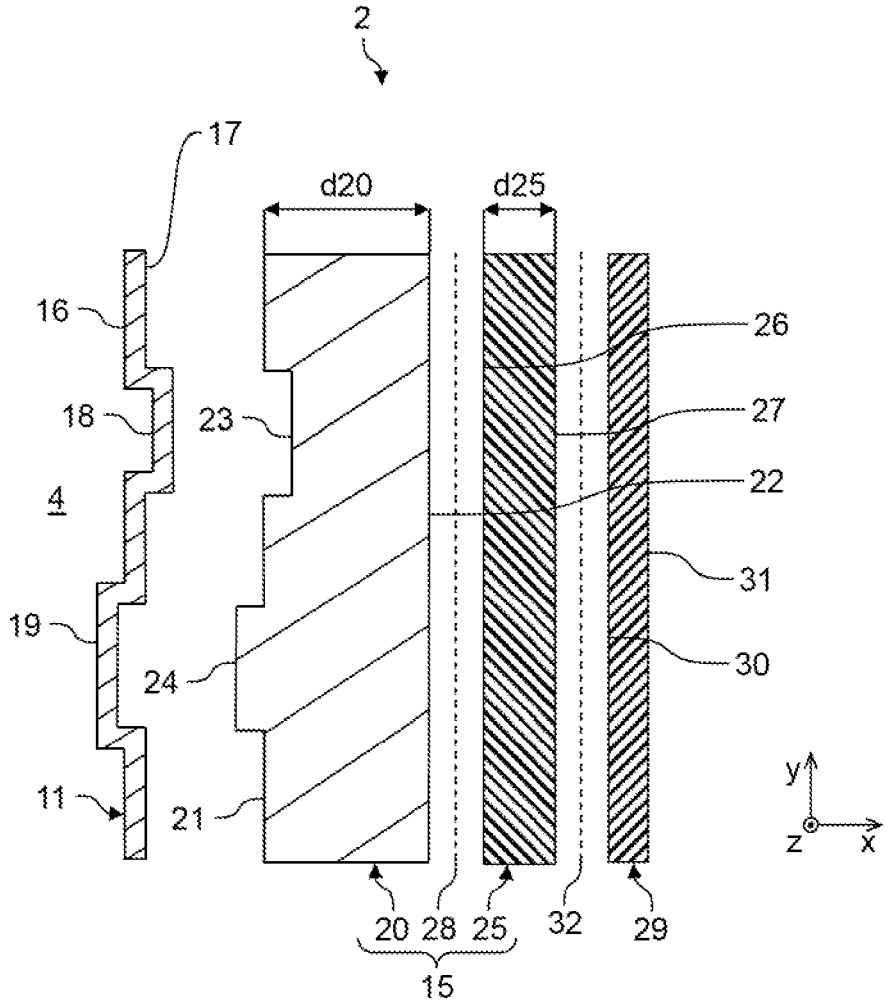
FIG. 2A shows a schematic part sectional view of an embodiment of a dishwasher cavity for the household dishwasher in accordance with FIG. 1, in an exploded view.
Figure 3A:
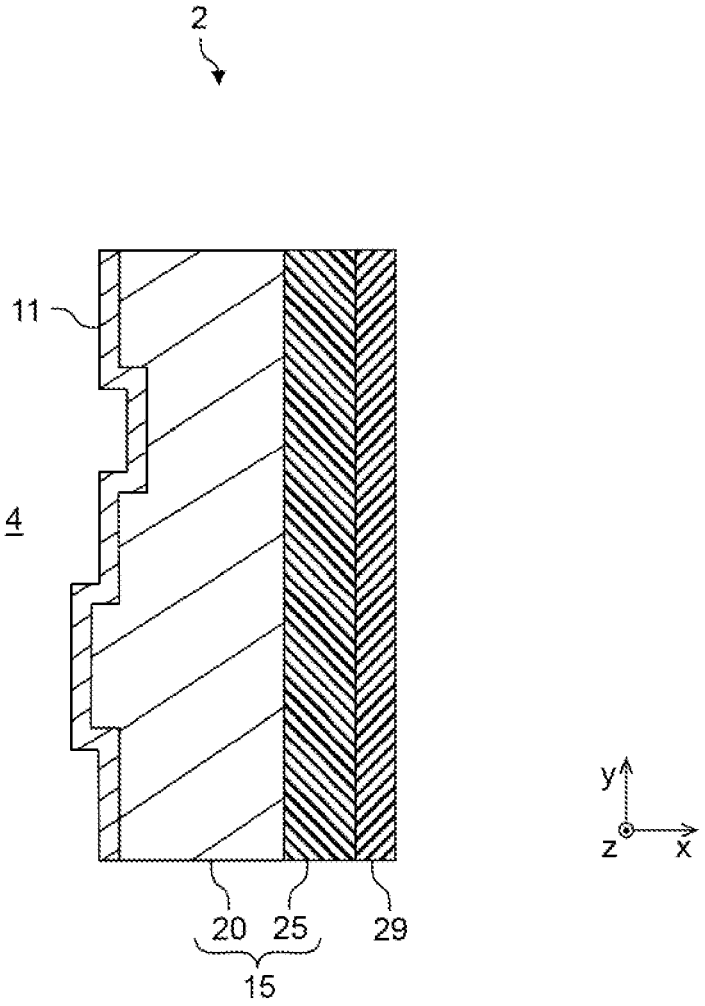
FIG. 3A shows a further schematic part sectional view of the dishwasher cavity in accordance with FIG. 2A.

FIG. 2A illustrates a schematic part sectional view of an embodiment of the dishwasher 2 in an exploded view. FIG. 3A illustrates a further part sectional view of the dishwasher cavity 2. Only the side wall 11 of the dishwasher cavity 2 is illustrated in the FIGS. 2A and 3A. The household dishwasher 1 comprises an insulation arrangement 15 so as to provide the thermal and/or acoustic insulation of the dishwasher cavity 2. The insulation arrangement 15 can be provided on the two side walls 10, 11, the ceiling 8, the rear wall 9 and/or the door 3. The insulation arrangement 15 can moreover also be provided on the bottom 7. In other words, the dishwasher cavity 2 can be accommodated in the insulation arrangement 15 and encompassed or enclosed at least in sections by said insulation arrangement 15. The insulation arrangement 15 is provided on the outside of the dishwasher cavity 2. The term "on the outside" means in this case remote from the dishwasher interior 4.

The side wall 11 comprises in particular an inner face 16, which faces the dishwasher interior 4, and an outer face 17, which is remote from the dishwasher interior 4. The insulation arrangement 15 is provided on the outer face 17. The side wall 11 or the dishwasher cavity 2 can have an elevation 18 on the outside. The elevation 18 curves upward out of the outer face 17 away from the dishwasher interior 4. The elevation 18 can be a corrugation or embossed feature shaped into the dishwasher cavity 2. Any desired number of elevations 18 can be provided.

Moreover, the side wall 11 can have a depression 19 that extends in the direction of the dishwasher interior 4. The depression 19 extends out of the inner face 16 into the dishwasher interior 4. In a similar manner to the elevation 18, the depression 19 can be a corrugation or embossed feature shaped into the dishwasher cavity 2. For example, the elevation 18 and the depression 19 can be suitable for the purpose of reinforcing the side wall 11. Any desired number of depressions 19 can be provided. The elevation 18 and the depression 19 are optional. The elevation 18 and the depression 19 can extend along a z-direction or depth direction z (arrow) and/or along a y-direction or height direction y (arrow) of the dishwasher cavity 2. Furthermore, an x-direction or width direction x (arrow) of the dishwasher cavity 2 is also illustrated in the FIGS. 2A and 3A. The directions x, y, z form a coordinate system of the dishwasher cavity 2.

The insulation arrangement 15 comprises a first insulation element 20. The first insulation element 20 is suitable for thermally and/or acoustically insulating the dishwasher cavity 2. The first insulation element 20 can also be referred to as the thermal and/or acoustic insulation element. The first insulation element 20 has a first surface 21 that faces the outer face 17 of the side wall 11. Furthermore, the first insulation element 20 comprises a second surface 22 that is remote from the first surface 21. An optional depression 23 that corresponds with the elevation 18 of the side wall 11 is provided on the first surface 21. In this case, the elevation 18 can engage in the depression 23 in a positive-locking manner. A positive-locking connection is produced by the at least two connection partners, in this case the elevation 18 and the depression 23, engaging in or behind one another. Any desired number of depressions 23 can be provided.

Furthermore, an optional elevation 24 that corresponds with the depression 19 of the side wall 11 is provided on the first surface 21. The elevation 24 can engage in the depression 19 in a positive-locking manner. Consequently, the first insulation element 20 can be connected to the dishwasher cavity 2 in a positive-locking manner. In this case, the positive-locking connection has an amount of play. The term "amount of play" means in this case that a depth of the depression 23 is greater when viewed in the width direction x (arrow) than a height of the elevation 18 when viewed in the width direction x (arrow). Accordingly, a width of the depression 23 when viewed in the height direction y (arrow) is greater than a width of the elevation 18 when viewed in the height direction y (arrow). This applies in a similar manner for the depression 19 and the elevation 24.

The first insulation element 20 is preferably manufactured from a foamed synthetic material, in particular from a foamed polyurethane. It is preferred that the first insulation element 20 has an open pore structure with the result that the first insulation element 20 can be compressed. The synthetic material has the property that in a cured and/or cross-linked state it has preferably adhering or preferably adhesive properties. The preferably adhesive properties are provided in particular on the surfaces 21, 22 of the first insulation element 20. In this case, the synthetic material itself has the preferably adhesive properties without the addition of an adhesive.

By virtue of the fact that the first surface 21 has preferably adhesive properties, the first insulation element 20 can adhere by means of the first surface 21 that is facing the dishwasher cavity 2 to the dishwasher cavity 2 or rather to the side wall 11. In this case, the connection between the side wall 11 and the first insulation element 20 is made without the use of an adhesive. In other words, an adhesive layer is not provided between the side wall 11 and the first insulation element 20. Thus, the first insulation element 20 can be released from the side wall 11 in a non-destructive and residue-free manner. During the procedure of releasing the first insulation element 20 from the side wall 11, it is also possible for negligible amounts of residue of the first insulation element 20 to remain on the side wall 11. This residue can however be rubbed off in a simple manner.

The first insulation element 20 has a thickness d20. The thickness d20 amounts preferably to 5 to 50 mm, further preferably 10 to 45 mm, further preferably 15 to 40 mm, further preferably 20 to 35 mm, further preferably 25 to 30 mm. A density p20 of the first insulation element 20 amounts preferably to 5 to 150 kg/m$^3$, particularly preferably 50 to 120 kg/m$^3$, further preferably 70 to 100 kg/m$^3$. A specific thermal conductivity $\lambda$20 of the first insulation element 20 is preferably less than 0.1 W/(m*K), in particular less than 0.05 W/(m*K). Furthermore, it is preferred that the first insulation element 20 has a specific thermal capacity c20 of less than 2,000 J/(kg*K), preferably of less than 1,600 J/(kg*K), further preferably of less than 1,400 J/(kg*K).

The insulation arrangement 15 comprises in addition to the first insulation element 20 a second insulation element 25 so as to provide the acoustic insulation of the dishwasher cavity 2. The second insulation element 25 can also be referred to as an acoustic insulation element. The second insulation element 25 is used in particular as a mass layer and improves the acoustic properties of the insulation arrangement 15. The second insulation element 25 is likewise provided on the outside of the dishwasher cavity 2. In this case, the first insulation element 20 is positioned between the dishwasher cavity 2 and the second insulation element 25. The second insulation element 25 comprises a first surface 26, which is facing the first insulation element 20, and a second surface 27 that is remote from the first surface 26. It is preferred that the second insulation element 25 can be separated from the first insulation element 20 in a non-destructive manner. The second insulation element 25 can however also be connected to the first insulation element 20 in a non-releasable manner.

The second insulation element 25 has a thickness d25. The thickness d25 is less than the thickness d20 of the first insulation element 20. For example, the thickness d25 can amount to 1 to 10 mm, preferably 1 to 8 mm, further preferably 1 to 5 mm, further preferably 1 to 3 mm. In particular, the first insulation element 20 prevents heat being transferred from the dishwasher cavity 2 to the second insulation element 25. Thus, the second insulation element 25 cannot draw off any heat from the dishwasher cavity 2. As a consequence, the energy efficiency of the household dishwasher 1 is improved. Vibrations of the dishwasher cavity 2 are converted to heat in the second insulation element 25.

The first insulation element 20 is, as already previously mentioned, suitable for damping vibrations. A loss factor of the synthetic material of the first insulation element 20 is high and is tailored to suit use in the household dishwasher 1. The term "loss factor" is to be understood in the present case in the case of physical vibrations of a different nature to be the ratio of the loss-involving imaginary part to the loss-free actual part of a complex variable. The loss factor of the synthetic material of the first insulation element 20 at 20° C. is in particular greater than 0.2, preferably greater than 0.4. Furthermore, the hysteresis loss in accordance with the IFD method ("hysteresis loss—IFD") according to ASTM D3574 is preferably 15% greater, preferably 20% greater, in particular 30% greater and the recovery time according to ASTM D3574 is preferably 2 s greater, preferably 4 greater, in particular 5 s greater. To some extent, the vibrations are also transferred to the second insulation element 25. By virtue of its high density, the second insulation element 25 essentially provides a surface mass in the combination of the insulation arrangement 15.

It is preferred that the second insulation element 25 has a considerably greater density than the first insulation element 20. It is preferred that the second insulation element 25 is manufactured from a bitumen material, in particular from a metal-filled and/or stone-filled bitumen material, or from a synthetic material, in particular from a metal-filled and/or stone-filled synthetic material. For example, the second insulation element 25 can be manufactured from a butyl material. The second insulation element 25 is in particular plate-shaped or mat-shaped. The second insulation element 25 can also be a metal sheet, in particular a steel sheet.

The second insulation element 25 is used to damp the noise of the dishwasher cavity 2 or to damp the vibrations of the dishwasher cavity 2. The second insulation element 25 has preferably a highest possible loss factor. The loss factor of the material of the second insulation element 25 at 20° C. is preferably greater than 0.08, further preferably greater than 0.15. A density p25 of the second insulation element 25 is preferably greater than 1,000 kg/m$^3$.

Furthermore, the insulation arrangement 15 can comprise an optional separation layer 28. The separation layer 28 is positioned between the first insulation element 20 and the second insulation element 25, in particular between the surfaces 22, 26. The separation layer 28 can be a wax layer, a film, for example a polyethylene film or the like. The separation layer 28 can also comprise multiple films. The separation layer 28 renders it possible to separate the second insulation element 25 from the first insulation element 20 in a non-destructive and residue-free manner.

The household dishwasher 1 can furthermore comprise an external cladding 29. The external cladding 29 can be arranged on the outside of the insulation arrangement 15, in particular on the outside of the second insulation element 25. The external cladding 29 can be for example a steel plate. The external cladding 29 can be part of a housing of the household dishwasher 1. The external cladding 29 can be in particular also part of the insulation arrangement 15.

The external cladding 29 can comprise a first surface 30, which is facing the second insulation element 25, and also a second surface 31 that is remote from the second insulation element 25. The external cladding 29 can be either releasably connected to the second insulation element 25 or connected thereto in such a manner that the external cladding 29 can be released from the second insulation element 25 in a residue-free and non-destructive manner. For this purpose, a separation layer 32 can be provided between the second insulation element 25 and the external cladding 29. The separation layer 32 is optional. The separation layer 32 can be constructed in an identical manner to that of the separation layer 28.

Figure 2B:
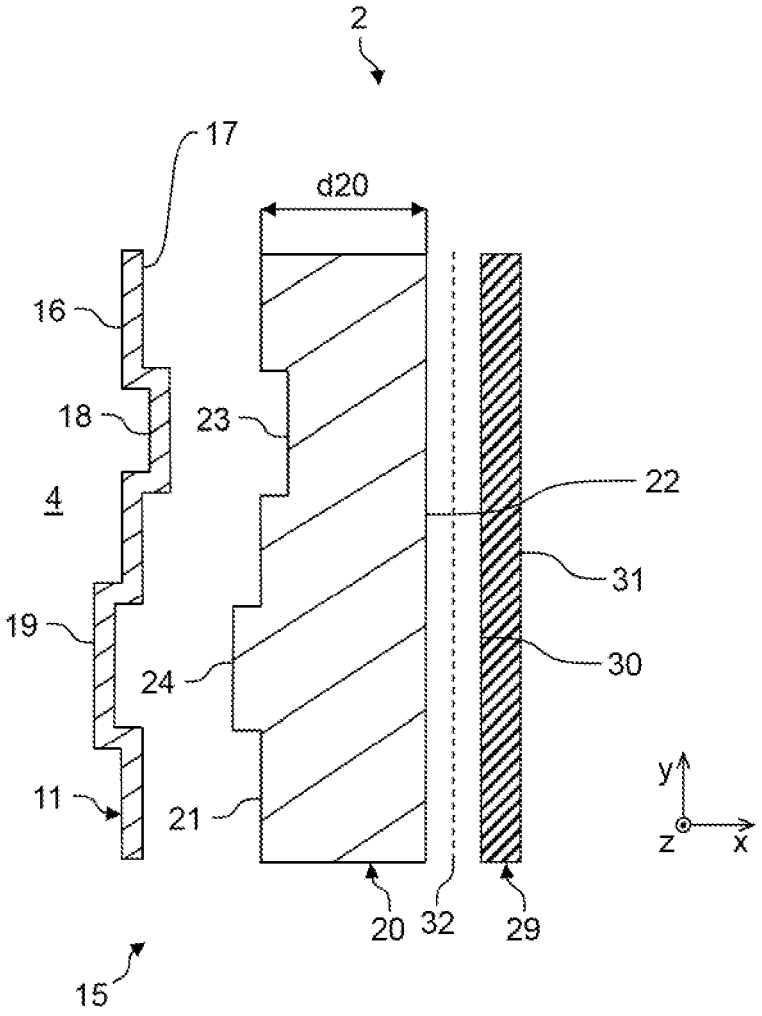
FIG. 2B shows a schematic part sectional view of a further embodiment of a dishwasher cavity for the household dishwasher in accordance with FIG. 1, in an exploded view.
Figure 3B:
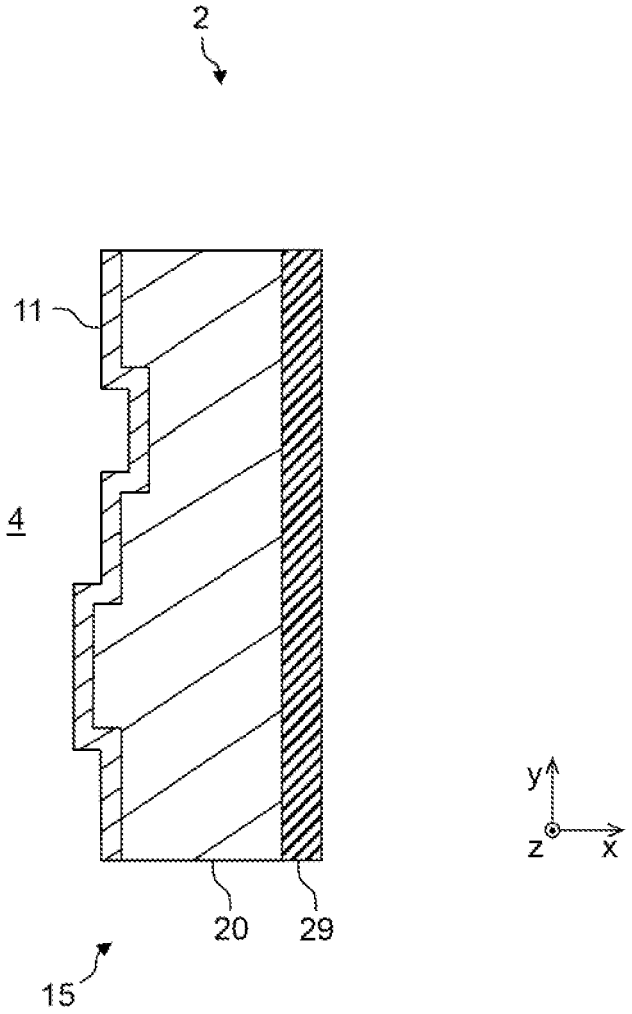
FIG. 3B shows a further schematic part sectional view of the dishwasher cavity in accordance with FIG. 2B.

FIG. 2B illustrates a schematic part sectional view of a further embodiment of the dishwasher cavity 2 in an exploded view. FIG. 3B illustrates a further part sectional view of the dishwasher cavity 2. The dishwasher cavity 2 in accordance with the FIGS. 2B and 3B differs from the dishwasher cavity 2 in accordance with the FIGS. 2A and 3A only by virtue of the fact that the insulation arrangement 15 has only the first insulation element 20. The second insulation element 25 is in particular not provided.

FIGS. 4 to 7 illustrate schematically a method for producing a previously described household dishwasher 1. In a step S1, the dishwasher cavity 2 is provided. Prior to or while dishwasher cavity 2 is being provided in the step S1, said dishwasher cavity 2 is manufactured for example from a steel plate that is reshaped, for example expanded and/or embossed.

Figure 4:
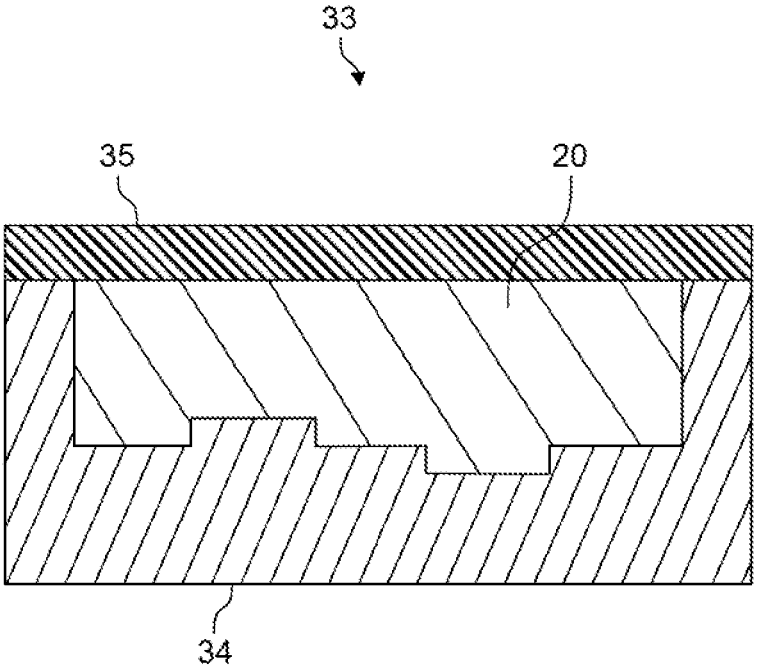
FIG. 4 shows a schematic sectional view of an embodiment of a mold for producing an insulation element for the dishwasher cavity in accordance with FIG. 2A or FIG. 2B.
Figure 5:
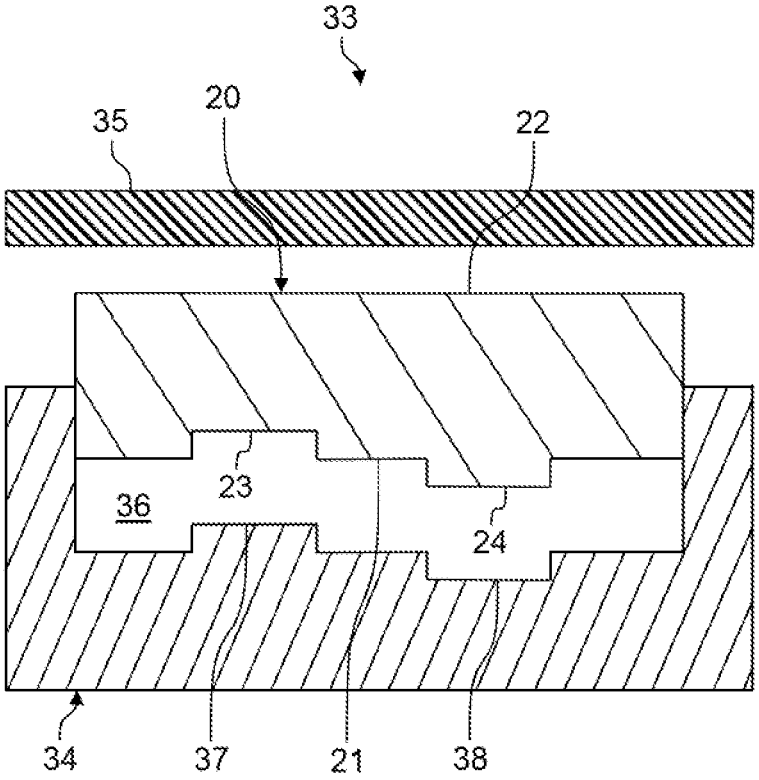
FIG. 5 shows a further schematic sectional view of the mold in accordance with FIG. 4.

In a step S2, the insulation arrangement 15 is provided. The step S2 comprises manufacturing the first insulation element 20. For this purpose, as illustrated in FIGS. 4 and 5, a mold 33, in particular a casting mold or pouring mold, which has a mold lower part 34 and a mold upper part 35, is filled with the synthetic material. For example, the synthetic material, as previously explained, is a polyurethane foam. In order to manufacture the first insulation element 20, two components are for example mixed and filled into the mold 33, which has a cavity 36 (FIG. 5) that represents a negative relief of an external geometry of the first insulation element 20. The synthetic material can then be foamed under ambient pressure or in a vacuum and the cavity 36 completely filled.

For example, the cavity 36 comprises an elevation 37, which complements the depression 23 on the first insulation element 20, and a depression 38 that complements the elevation 24 of the first insulation element 20. After the synthetic material has become completely cured and/or cross-linked, the mold 33, as illustrated in FIG. 5, is opened and the first insulation element 20 is removed. In this case, the surfaces 21, 22 also continue to be preferably adhesive or preferably tacky after the synthetic material of the first insulation element 20 has become completely cured and/or cross-linked.

Figure 6:
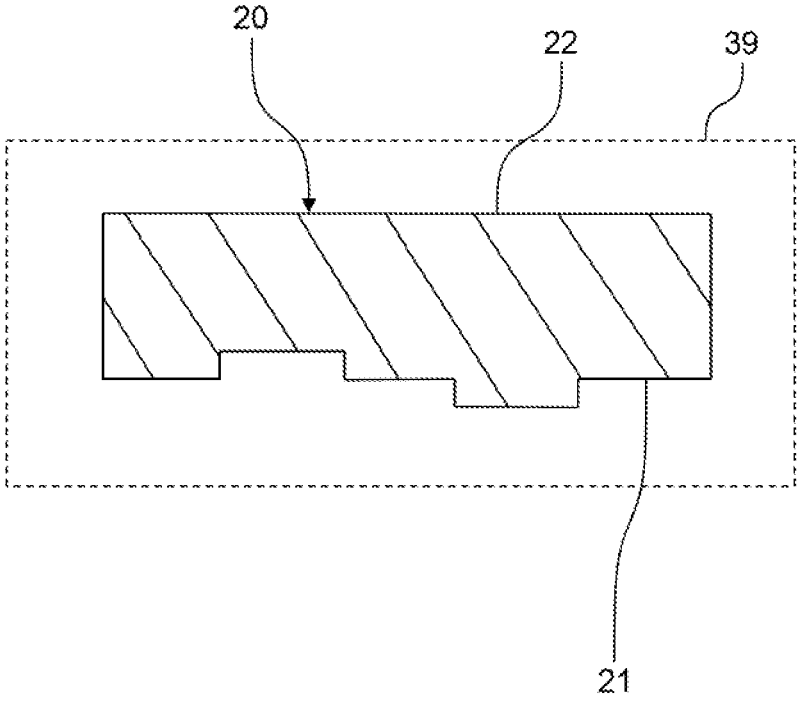
FIG. 6 shows a schematic sectional view of an embodiment of an insulation element for the dishwasher cavity in accordance with FIG. 2A or FIG. 2B.
Figure 7:
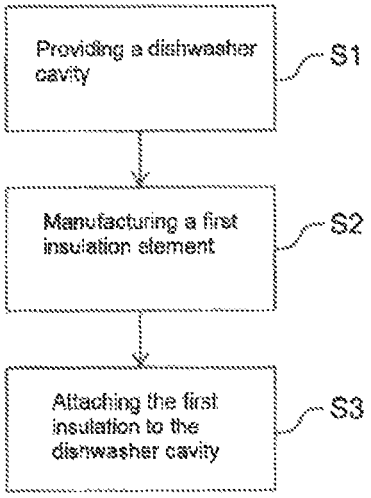
FIG. 7 shows a schematic block diagram of an embodiment of a method for producing the household dishwasher in accordance with FIG. 1.

In order to protect the surfaces 21, 22 or at least the first surface 21 against dust and/or contaminants after the step S2, the first insulation element 20, as illustrated in FIG. 6, can be packaged in a protective film 39. The protective film 39 can be bag-shaped and can accommodate the entire first insulation element 20. Alternatively, the protective film 39 can also be attached as a pull-off film onto one of the surfaces 21, 22 or onto both surfaces 21, 22.

In a step S3, after the protective film 39 is removed from at least the first surface 21, the first insulation element 20 is attached to the outside of the dishwasher cavity 2 with the result that the first insulation element 20 adheres by means of its first surface 21 to the dishwasher cavity 2 but can be separated therefrom in a non-destructive and residue-free manner.

Likewise in the step S2, the second insulation element 25 is optionally provided, for example as a bitumen mat, and after or during the step S3 is attached to the outside of the dishwasher cavity 2 in such a manner that the first insulation element 20 is arranged between the dishwasher cavity 2 and the second insulation element 25. Alternatively, the second insulation element 25 can also be connected to the first insulation element 20 prior to the first insulation element 20 being attached to the outside of the dishwasher cavity 2 in the step S3. In other words, the insulation arrangement 15 can be pre-assembled and in the step S3 attached as a whole to the outside of the dishwasher cavity 2. As previously mentioned, the second insulation element 25 can also be omitted.

Figure 8:
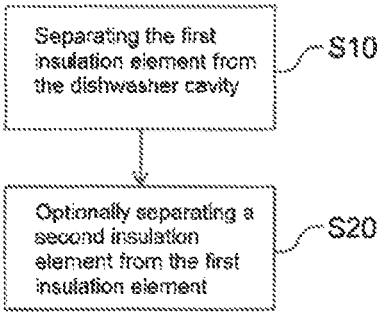
FIG. 8 shows a schematic block diagram of an embodiment of a method for dismantling a household dishwasher that is produced with the aid of the method in accordance with FIG. 7.

In the case of a method illustrated in FIG. 8 for dismantling a household dishwasher 1 that is produced with the aid of the method illustrated in FIGS. 4 to 7, the first insulation element 20 is separated from the dishwasher cavity 2 in a non-destructive manner in a step S10. In this case, it is preferred that no residue or only a negligible amount of residue of the first insulation element 20 remains adhered to the dishwasher cavity 2 with the result that the dishwasher cavity 2 can be supplied to the recycling loop for recycling without first having to be cleaned. In an optional step S20, the second insulation element 25 is separated from the first insulation element 20. Thus, the separation layer 28 can render it possible for example to release the second insulation element 25 from the first insulation element 20 in a residue-free and non-destructive manner. The dishwasher cavity 2, the insulation elements 20, 25 and also the external cladding 29 can consequently be separated from one another at the end of the serviceable life of the household dishwasher 1 and supplied to the recycling loop for recycling without first having to be cleaned.

By virtue of using the preferably adhesive properties of the surfaces 21, 22 of the first insulation element 20, it is possible during the production of the household dishwasher 1 to forego one method step, for example the step of attaching an adhesive layer to the first surface 21. This reduces the production costs of the household dishwasher 1. With the aid of the first insulation element 20, it is possible to attach the second insulation element 25 to the dishwasher cavity 2 in an acoustically advantageous manner. Thus, the acoustic properties of the entire household dishwasher 1 can be improved.

With the aid of the preferably adhesive first surface 21, it is possible to permanently fix the insulation arrangement 15 to the dishwasher cavity 2 without additional arrangements. In this case, a large part of the first surface 21 of the first insulation element 20 is in direct contact with the outer face 17 of the dishwasher cavity 2. By virtue of producing the dishwasher cavity 2 and the insulation arrangement 15 separately, advantages are realized during the manufacture of the household dishwasher 1. By virtue of the fact that the positive-locking connection between the first insulation element 20 and the dishwasher cavity 2 has an amount of play, the first insulation element 20 can be manufactured with large tolerances. This reduces the production costs of the household dishwasher 1.

By virtue of the fact that the first insulation element 20 can be released from the dishwasher cavity 2 in a residue-free and non-destructive manner, the dishwasher cavity 2 and the first insulation element 20 can be recycled separately from one another. For example, the dishwasher cavity 2 can be melted down without first having to be cleaned. By virtue of the fact that the second insulation element 25 can be separated from the first insulation element 20 in a residue-free and non-destructive manner, the material of the second insulation element 25 can also be recycled separately from the material of the first insulation element 20. If the insulation arrangement 15 is manufactured as a pre-assembled one-part arrangement, the insulation arrangement 15 can be removed completely from the dishwasher cavity 2 and recycled. The individual components of the insulation arrangement 15 can be separated from one another and supplied to the recycling loop without contaminants.

Advantageously, the external cladding 29 can be connected to the insulation arrangement 15 in an easily releasable manner with the result that the external cladding 29 that is manufactured mainly from metal can be supplied to the recycling loop again. The procedure of separating the components of the insulation arrangement 15 from one another can be simplified with the aid of the separation layers 28, 32. It is consequently possible to realize a simplified separability and to recycle materials. The individual components of the household dishwasher 1 can be supplied to the recycling loop separately from one another. Due to the residue-free separation, few contaminants occur, which renders possible high grade reuse of the materials. The recycling process is consequently significantly simplified.

Although the present invention has been described with the aid of exemplary embodiments, it can be modified in numerous ways.

The invention claimed is:

1. A household appliance, comprising:

a functional cavity; and an insulation arrangement arranged on an outside of the functional cavity for thermal and/or acoustic insulation of the functional cavity, said insulation arrangement including a one-piece first insulation element of a synthetic material which is selected such that a surface of the first insulation element in facing relation to the functional cavity adheres to the functional cavity and is separable therefrom in a non-destructive manner, wherein the first insulation element is connected in a positive-locking manner to the functional cavity, and wherein the outside of the functional cavity includes an elevation which engages in the positive-locking manner in a depression of the first insulation element or wherein the outside of the functional cavity includes a depression into which an elevation of the first insulation element engages in the positive-locking manner.

2. The household appliance of claim 1, constructed in the form of a household dishwasher.

3. The household appliance of claim 1, wherein the functional cavity is a dishwasher cavity.

4. The household appliance of claim 1, wherein the synthetic material has an adhesive property in a cured and/or cross-linked state.

5. The household appliance of claim 1, wherein the synthetic material is a polyurethane.

6. The household appliance of claim 1, wherein the synthetic material is a foamed polyurethane.

7. The household appliance of claim 1, wherein the synthetic material has a viscoelastic property.

8. The household appliance of claim 1, wherein the insulation arrangement includes a second insulation element, with the first insulation element being arranged between the functional cavity and the second insulation element.

9. The household appliance of claim 8, wherein the first insulation element has in facing relation to the second insulation element another surface via which the first insulation element adheres to the second insulation element, said first insulation element being separable from the second insulation element in a non-destructive manner.

10. The household appliance of claim 8, further comprising a separation layer arranged between the first insulation element and the second insulation element in order to separate the first insulation element from the second insulation element in a non-destructive manner.

11. The household appliance of claim 8, further comprising an external cladding provided on the outside of the functional cavity, said second insulation element being arranged between the first insulation element and the external cladding.

12. The household appliance of claim 11, wherein the external cladding lies loosely on the second insulation element.

13. The household appliance of claim 11, further comprising a separation layer arranged between the second insulation element and the external cladding in order to separate the external cladding from the second insulation element in a non-destructive manner.

14. The household appliance of claim 1, wherein the connection in the positive-locking manner between the first insulation element and the functional cavity has an amount of play.

15. A method for producing a household appliance, said method comprising:

producing a first insulation element of a synthetic material as part of an insulation arrangement for thermal and/or acoustic insulation of a functional cavity; and attaching the insulation arrangement to an outside of a functional cavity in a positive-locking manner and in such a way that a surface of the first insulation element in facing relation to the functional cavity adheres to the functional cavity and is separable therefrom in a non-destructive manner, wherein the outside of the functional cavity includes an elevation which engages in the positive-locking manner in a depression of the first insulation element or wherein the outside of the functional cavity includes a depression into which an elevation of the first insulation element engages in the positive-locking manner.

16. The method of claim 15, further comprising:

producing the insulation arrangement with a second insulation element; and arranging the first insulation element between the functional cavity and the second insulation element, as the insulation arrangement is attached to the outside of the functional cavity.

17. The method of claim 16, further comprising adhering another surface of the first insulation element in facing relation to the second insulation element to the second insulation element in such a way that the first insulation element is separable from the second insulation element in a non-destructive manner.

18. The method of claim 16, further comprising arranging a separation layer between the first insulation element and the second insulation element in order to separate the first insulation element from the second insulation element in a non-destructive manner.

19. A method for dismantling a household appliance produced by a method as set forth in claim 15, said method for dismantling the household appliance comprising separating the insulation arrangement from the functional cavity in a non-destructive manner.

* * * * *